US006575272B1

(12) United States Patent
Krulik et al.

(10) Patent No.: US 6,575,272 B1
(45) Date of Patent: Jun. 10, 2003

(54) EXPANDABLE LUGGAGE WITH LOCKING EXPANSION MECHANISM

(75) Inventors: Richard J. Krulik, Dix Hills, NY (US); Georgene Rada, East Northport, NY (US); Jason V. Drew, Port Jefferson, NY (US)

(73) Assignee: Briggs & Riley Travelware LLC, Hauppauge, NY (US)

( * ) Notice: Subject to any disclaimer, the term of this patent is extended or adjusted under 35 U.S.C. 154(b) by 0 days.

(21) Appl. No.: 10/092,764

(22) Filed: Mar. 6, 2002

(51) Int. Cl.[7] ..... A45C 7/00
(52) U.S. Cl. ..... 190/103; 190/105
(58) Field of Search ..... 190/103–105, 190/107

(56) References Cited

U.S. PATENT DOCUMENTS

| | | | | | |
|---|---|---|---|---|---|
| 340,567 | A | * | 4/1886 | French | 190/105 |
| 672,143 | A | * | 4/1901 | Boughner | 190/104 |
| 701,440 | A | * | 6/1902 | Wilkinson | 190/105 |
| 1,642,851 | A | * | 9/1927 | Gadsby | 190/105 X |
| 1,756,775 | A | * | 4/1930 | Winning | 190/104 X |
| 2,110,617 | A | * | 3/1938 | Saling | 190/105 |
| 4,356,899 | A | | 11/1982 | Tawil | 190/44 |
| 4,844,215 | A | * | 7/1989 | Ambasz | 190/104 X |
| 5,080,206 | A | | 1/1992 | Tawil | 190/103 |
| 5,082,094 | A | * | 1/1992 | Nechushtan | 190/105 |
| 5,671,831 | A | | 9/1997 | Chiu | 190/103 |
| 5,819,891 | A | * | 10/1998 | Wang et al. | 190/103 |
| 6,021,874 | A | | 2/2000 | Nykoluk | 190/103 |
| 6,059,078 | A | | 5/2000 | Nykoluk | 190/103 |
| 6,220,411 | B1 | | 4/2001 | Scicluna et al. | 190/103 |
| 6,305,513 | B1 | | 10/2001 | Lu | 190/103 |
| 6,390,259 | B1 | * | 5/2002 | Lu | 190/103 |

FOREIGN PATENT DOCUMENTS

| | | | | |
|---|---|---|---|---|
| AU | 2026 | * | 4/1927 | 190/103 |
| DE | 2632589 | * | 1/1978 | 190/103 |
| FR | 946031 | * | 5/1949 | 190/103 |
| FR | 1557297 | * | 2/1969 | 190/103 |
| IT | 459299 | * | 4/1951 | 190/103 |

* cited by examiner

*Primary Examiner*—Sue A. Weaver
(74) *Attorney, Agent, or Firm*—Abelman, Frayne & Schwab

(57) ABSTRACT

An item of expandable luggage is provided with a multipositional locking expansion mechanism that includes a lock release actuator for unlocking the expansion plates that is located near or on a handle on the sliding plate situated towards the upper portion of the expandable body for easy accessibility, thereby permitting the user to adjust the inner volume of the luggage storage space when the compartment is fully packed. The extendable gusset is provided with one or more resilient members that retract the gusset into the interior of the luggage when it is not extended.

20 Claims, 11 Drawing Sheets

EXPANDABLE LUGGAGE WITH LOCKING EXPANSION MECHANISM

FIELD OF THE INVENTION

The present invention relates generally to expandable luggage, and particularly to expandable luggage having a zipperless expansion gusset with an easily accessible adjustable locking expansion mechanism.

BACKGROUND OF THE INVENTION

The needs of travelers for luggage space can vary considerably depending on the duration of a trip, types of clothing and other gear required, and the climate of the destination, to name a few. One way travelers accommodate these needs is by using expandable luggage that have heretofore been provided. Expandable luggage also offers the traveler a possible cost savings by avoiding the need to purchase more than one piece of luggage. Moreover, the capability of expanding a piece of luggage permits the traveler to change the carrying capacity throughout the course of a trip.

Expandable luggage of varying construction and designs are well known in the art.

Examples of existing expandable luggage include U.S. Pat. Nos. 6,220,411; 6,059,078; and 6,021,874, wherein '078 and '874 are commonly assigned to the present assignee. However, these designs have some disadvantages. For example, each of the luggage pieces disclosed therein contain an expandable portion or gusset requiring a zipper that must be manipulated into an open or closed position in order to expand or retract the expandable portion respectively. Zippers can become stuck and/or damaged due to wear and tear a typical piece of luggage encounters, or simply due to use over an extended period of time.

Another disadvantage pertains to the location of the various locking mechanisms for maintaining the luggage an expanded state. For example, in '411, the locking mechanism is located near the lower portion of the bridge plate at the bottom of the luggage, making the locking mechanism difficult to reach and operate when the luggage is packed and the user needs to increase the volume of the luggage to accommodate the storage of additional items. Similarly, the location of the hook and loop fastening mechanism in '078 and '874 used in adjusting the volume of the luggage disclosed therein is located near the bottom of the luggage, making the fastening mechanism difficult to reach and operate when the luggage is packed and the user needs to increase the volume of the luggage to accommodate the storage of additional items. There is therefore a need for an improved expandable luggage having zipperless expandable portion which overcomes these and other disadvantages associated with existing expandable luggage. As used herein "luggage" is intended to include all manner of containers, for example, but without limitation, briefcases.

SUMMARY OF THE INVENTION

In general, it is an object of the present invention to provide an expandable item of luggage, suitcase, bag or the like having an intermediately located zipperless expandable portion or gusset with a multipositional locking expansion mechanism. The interior storage volume of the item of luggage is easily adjusted, and directly corresponds to the retracted, various intermediate, and completely expanded states of the zipperless gusset.

The item of luggage preferably comprises a main body portion, an expandable body portion and an access panel. The main body has first (lower) and second (upper) support frame elements, inner and outer surfaces, a bottom wall, and a pair of opposing sidewalls. The expandable body portion is adjustably coupled to the main body by a multipositional locking expansion mechanism, and includes a support frame, a pair of opposing sidewalls and a zipperless expandable gusset. The zipperless expandable gusset is intermediately located between, and adjustably coupled to, the upper support frame element and the expandable body support frame.

The locking expansion mechanism preferably includes a locking element, a lock release element, a first expansion plate fastened to the upper and lower support frames of the main body, and a sliding second expansion plate fastened to the support frame of the expandable body portion. The first expansion plate includes a locking lug, preferably a pair of lugs, slidably coupled to a lug receiving slot, preferably a pair of slots, located on the second expansion plate. The locking expansion plates are slidably engageable and lockable to permit expansion and retraction of the zipperless gusset by adjustments in the height of the expandable body. The locking element is capable of engaging the locking lug in order to control the sliding and locking of the second expansion plate with respect to the first expansion plate. The lock release element for unlocking the expansion plates is easily operated and conveniently located near or on the sliding plate handle situated by the top region of the expanding body to provide for easy accessibility, thereby permitting the user to adjust the interior storage volume of the item of luggage without having to unpack in order to gain access to the unlocking mechanism, as is commonly the problem with expandable cases in the prior art. In a preferred embodiment, the item of luggage comprises a pair of locking expansion mechanisms located on opposing sidewalls.

The access panel is preferably attached to the expandable body portion by a zipper and hinged element. Additionally, one or more handles, straps or the like are preferably mounted on the outside of the luggage body for easy lifting and carrying, and wheels or the like are preferably mounted on the luggage for easy transport.

Another object of the invention is to provide an item of luggage further including a web of resilient plastic material or the like attached to the interior side of gusset between the gusset and the inner adjacent side walls of the main body and the expandable body. The web preferably extends between the respective opposing peripheral upper and extendable frame elements such that when the luggage is collapsed the gusset is drawn towards the interior region of the luggage, thereby allowing the opposing frame elements to come into contact without the user having to manually retract the gusset to the desired interior position. The web of resilient plastic material is preferably attached to the interior side of the gusset by an appropriate fastening means including, but not limited to an adhesive or the like.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

DETAILED DESCRIPTION OF THE PREFERRED EMBODIMENTS

Figure 1:
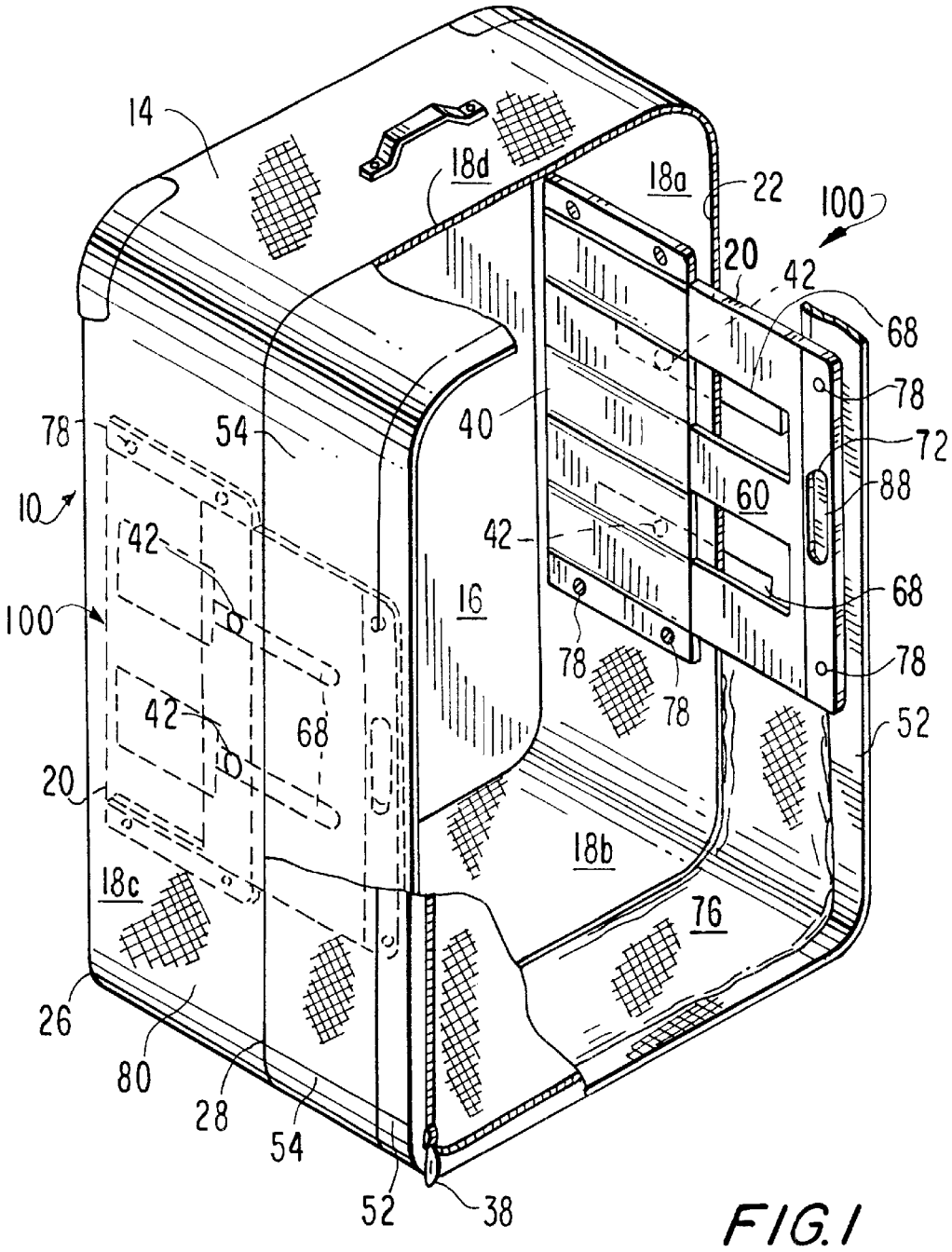
FIG. 1 is a partial cutaway view of an item of luggage fully expanded according to one embodiment of the invention.

Reference will now be made to the preferred embodiments of the invention, examples of which are illustrated in the accompanying drawings FIGS. 1–7. Wherever possible, the same reference numbers will be used throughout the drawings to refer to the same or like parts. An exemplary embodiment of an item of luggage, suitcase, bag or the like of the present invention is shown in FIG. 1, and is designated generally throughout by reference numeral 10.

Figure 2:
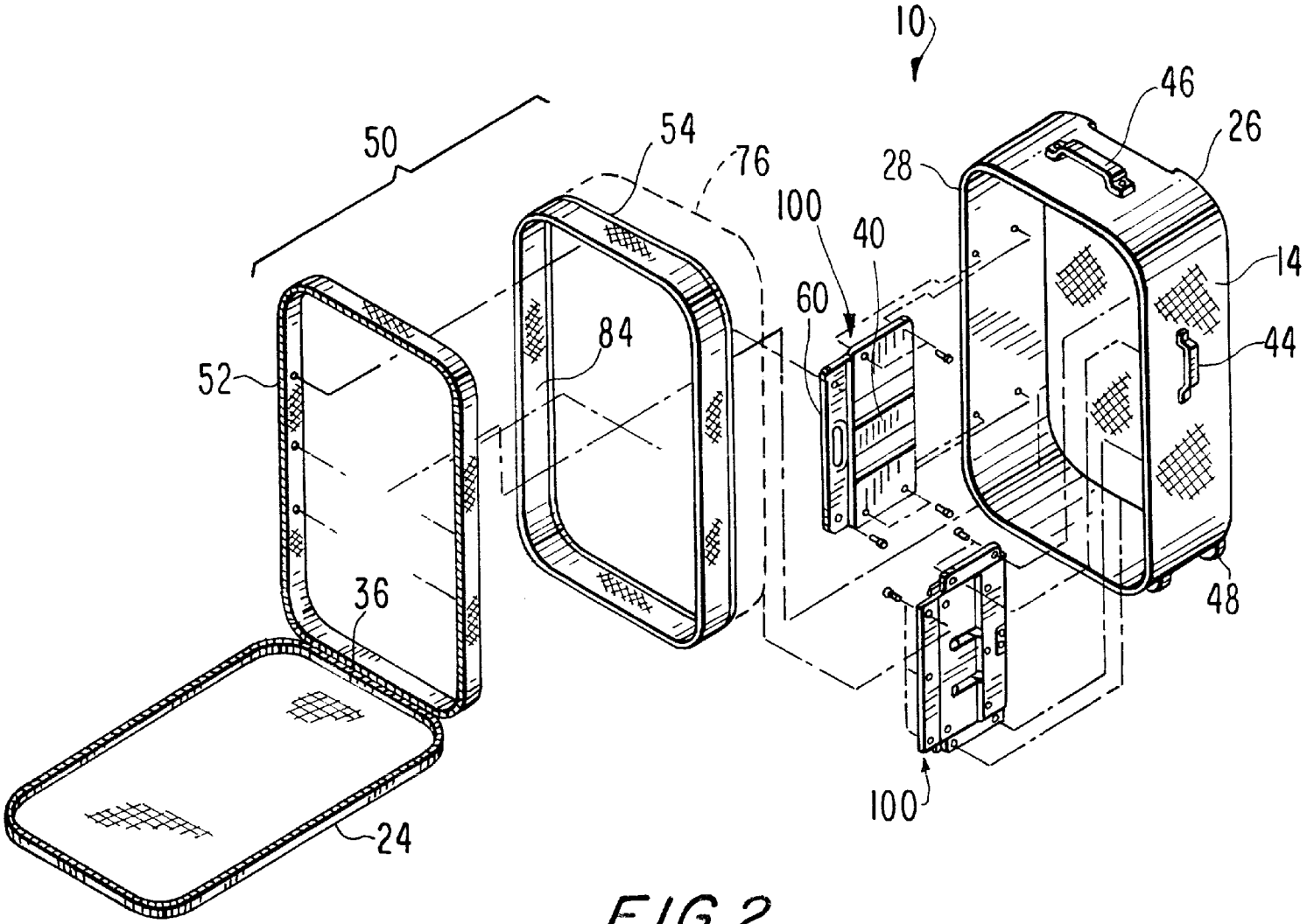
FIG. 2 is an exploded view of the item of luggage in FIG. 1.

Referring to FIGS. 1–7, there is depicted an item of luggage 10 including a multipositional locking expansion mechanism 20 for supporting the expansion and retraction of an expandable zipperless portion or gusset 54 in accordance with the invention. Item of luggage 10 includes a cover or skin 80 made of a suitable material, such as ballistic nylon, a main body 14, an expandable body portion 50, and an access panel 24. The access panel 24 is preferably attached to main body 14 by a zipper 38 as shown in FIG. 1 and a hinged element 36 as shown in FIG. 2. Main body 14 is supported by bottom wall 16, lower (first) support frame element 26, upper (second) support frame 28, and opposed outer side walls (18*a*,18*b*,18*c*,18*d*) as shown in FIG. 1. Expandable member 50 includes an expandable member support frame 52, a pair of opposing sidewalls, and an expandable zipperless gusset 54. Gusset 54 is intermediately located between and coupled to upper support frame 28 and expandable member support frame 52.

Multipositional expansion and locking mechanism 20, best shown in FIGS. 1,3–7C, preferably includes, a locking element 110, a lock release element 120, a substantially rectangular first stationary expansion plate 40, a substantially rectangular sliding second expansion plate 60 and a cover plate 75 that is removably attached to sliding plate 60. First expansion plate 40 is attached by appropriate fasteners 78 (e.g., bolts, screws) to passing through reinforced openings 55 upper 28 and lower 26 support frame members of main body 14, and sliding second expansion plate 60 is attached by appropriate fasteners 78 (e.g., bolts, screws) to expandable body support frame 52.

Figure 4:
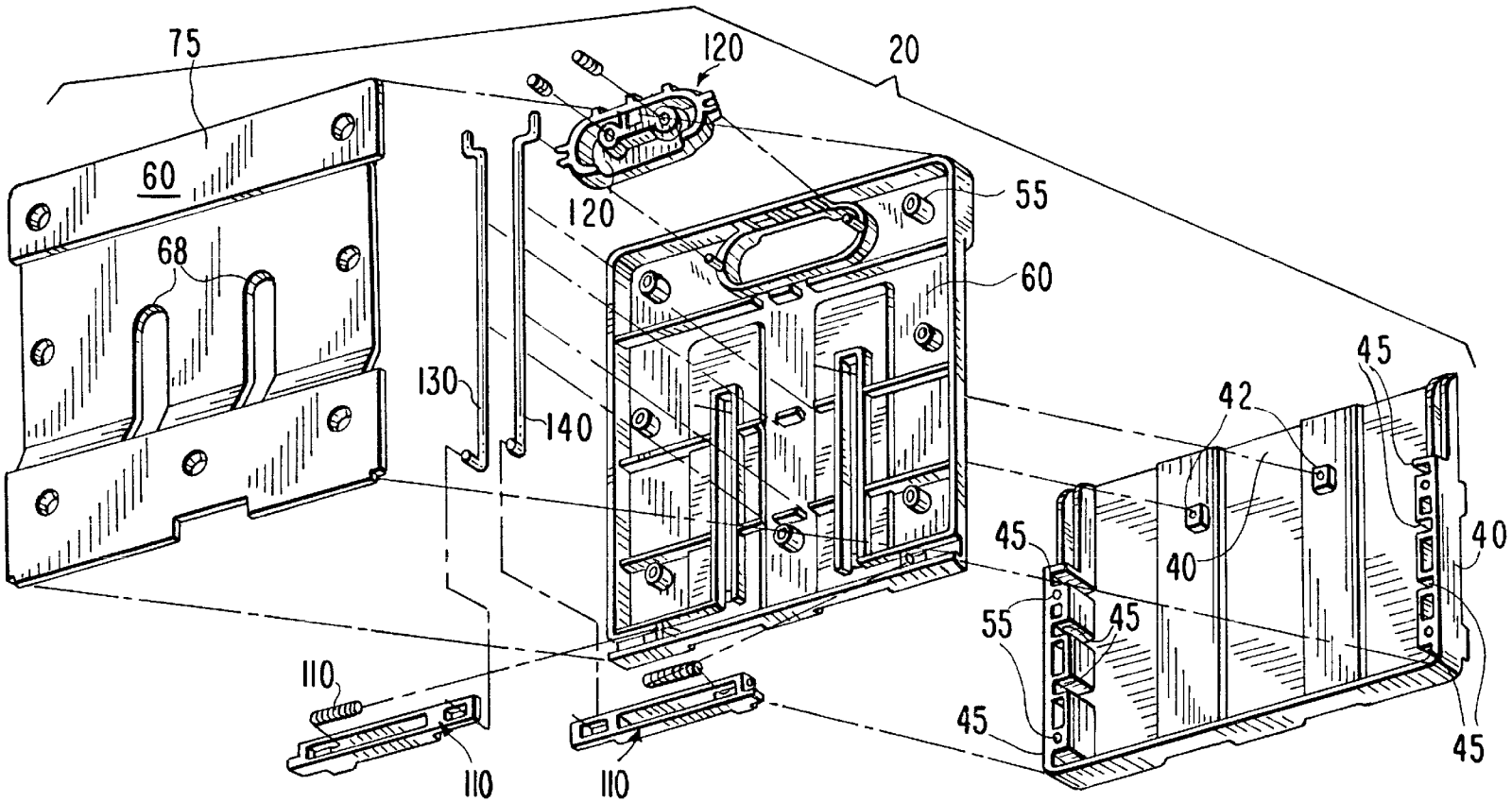
FIG. 4 is an exploded view of the locking expansion mechanism in FIG. 3.
Figure 5A:
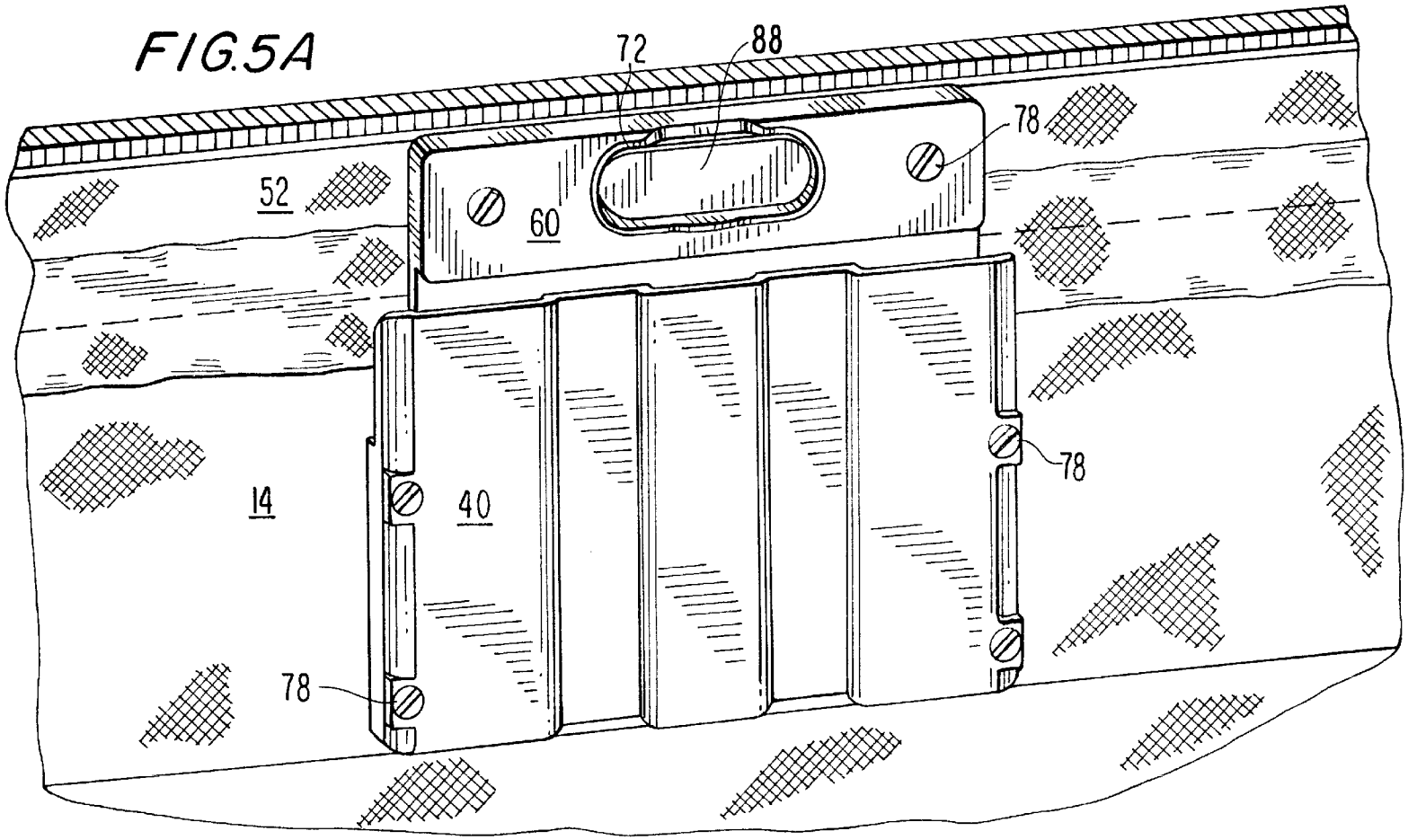
FIG. 5A is an interior plan view of the item of luggage and locking expansion mechanism in the fully retracted state.
Figure 5B:
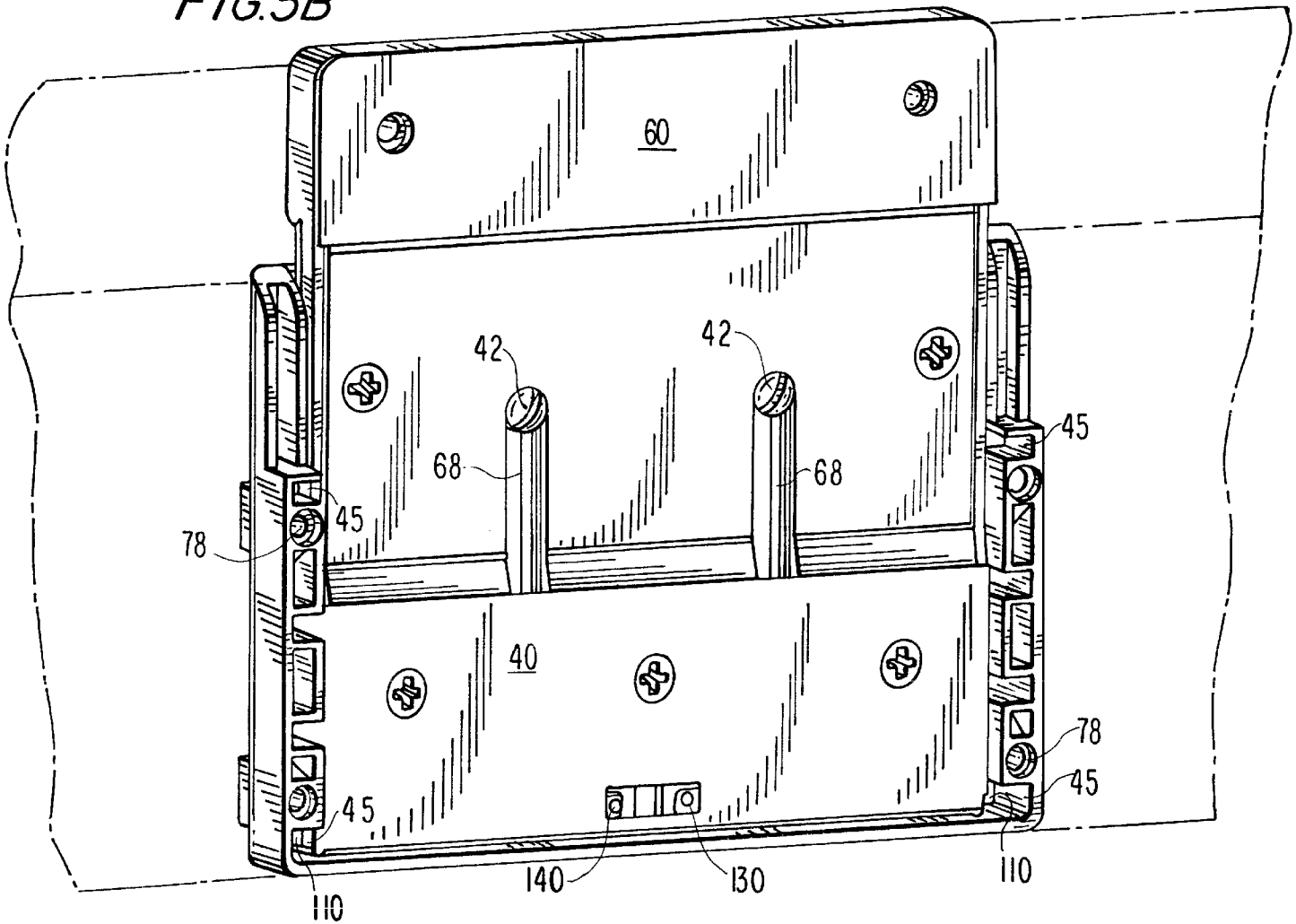
FIG. 5B is an exterior plan view of the item of luggage and locking expansion mechanism in FIG. 5A.
Figure 6:
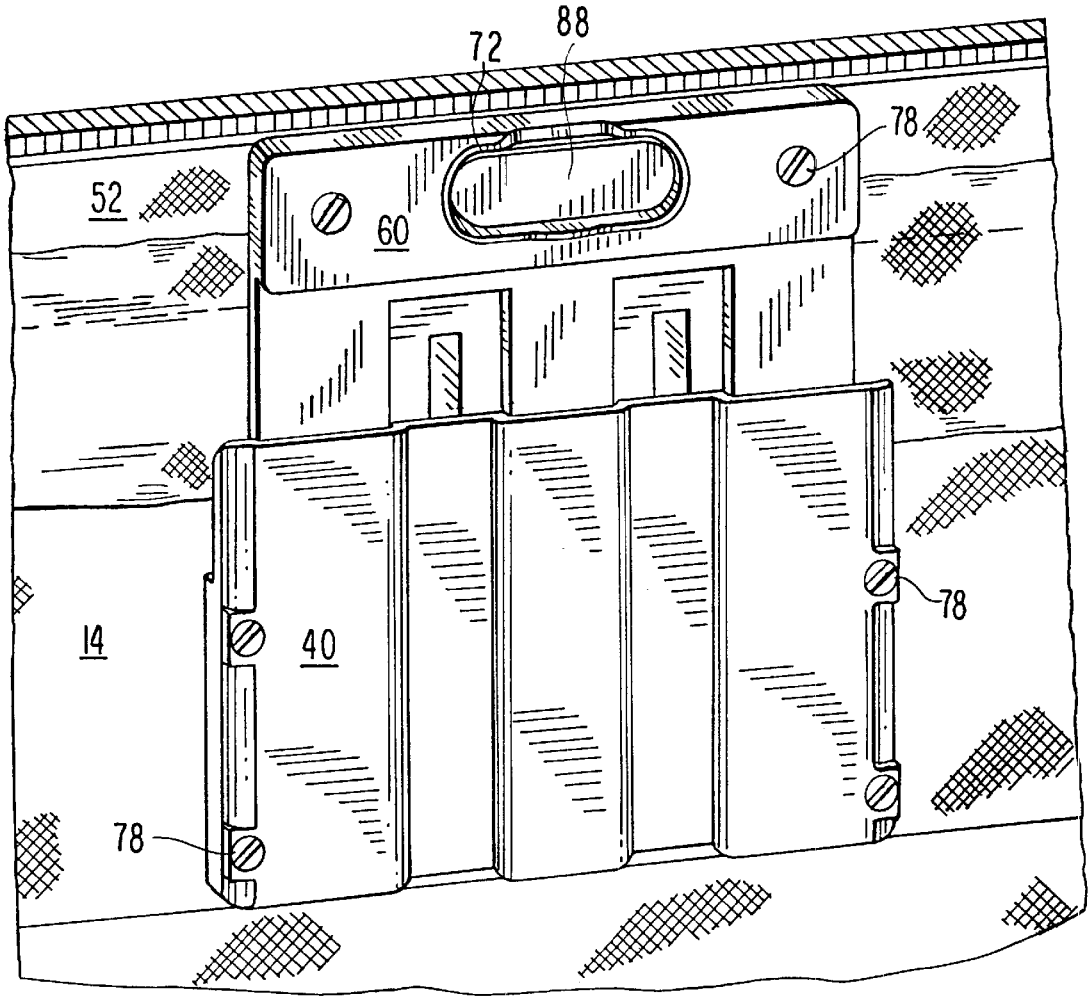
FIG. 6 is an interior plan view of the item of luggage and locking expansion mechanism in FIG. 5A in an intermediate position between the fully extended and retracted positions.
Figure 7A:
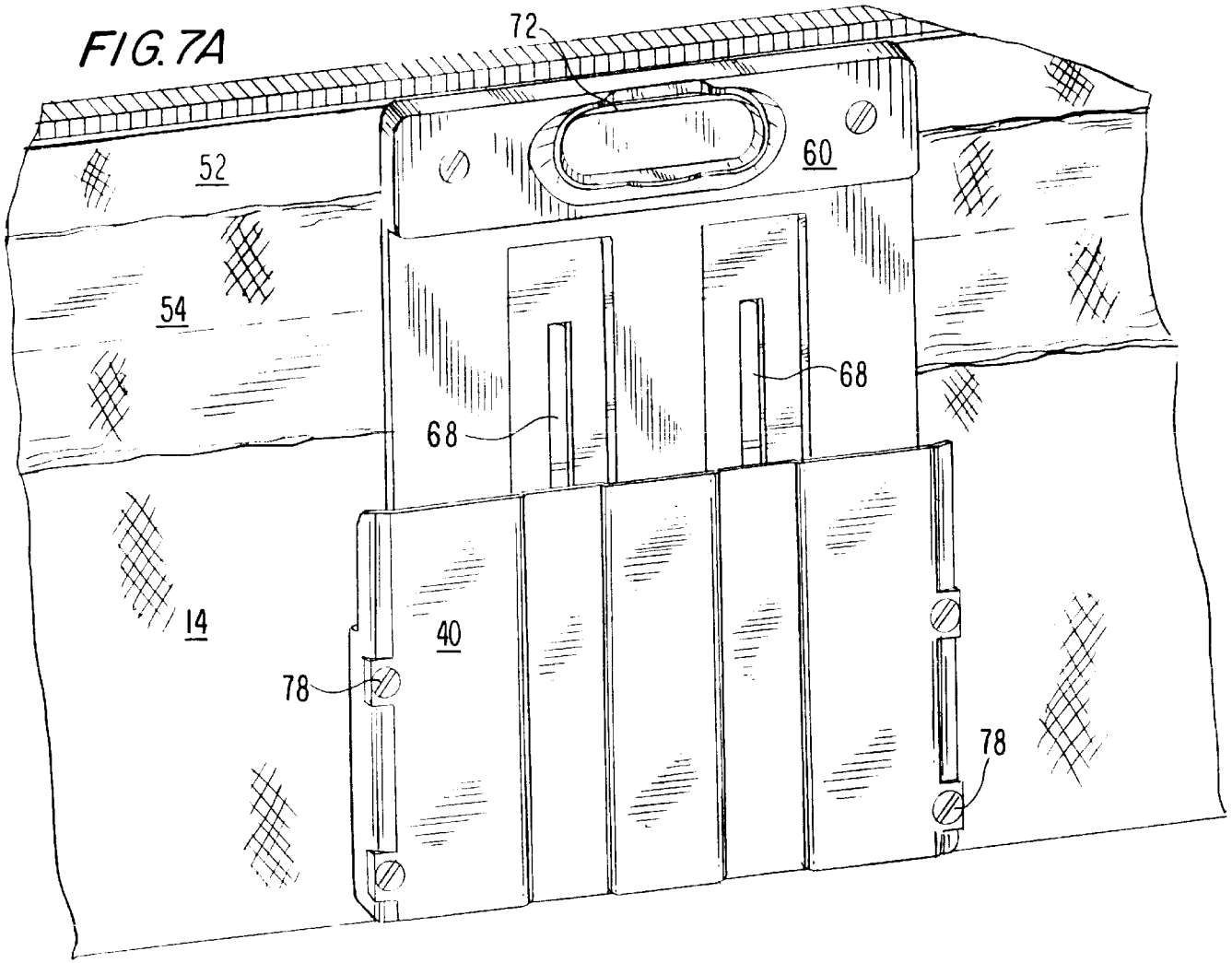
FIG. 7A is an interior plan view of the item of luggage and locking expansion mechanism in FIG. 5A in the fully extended position.
Figure 7B:
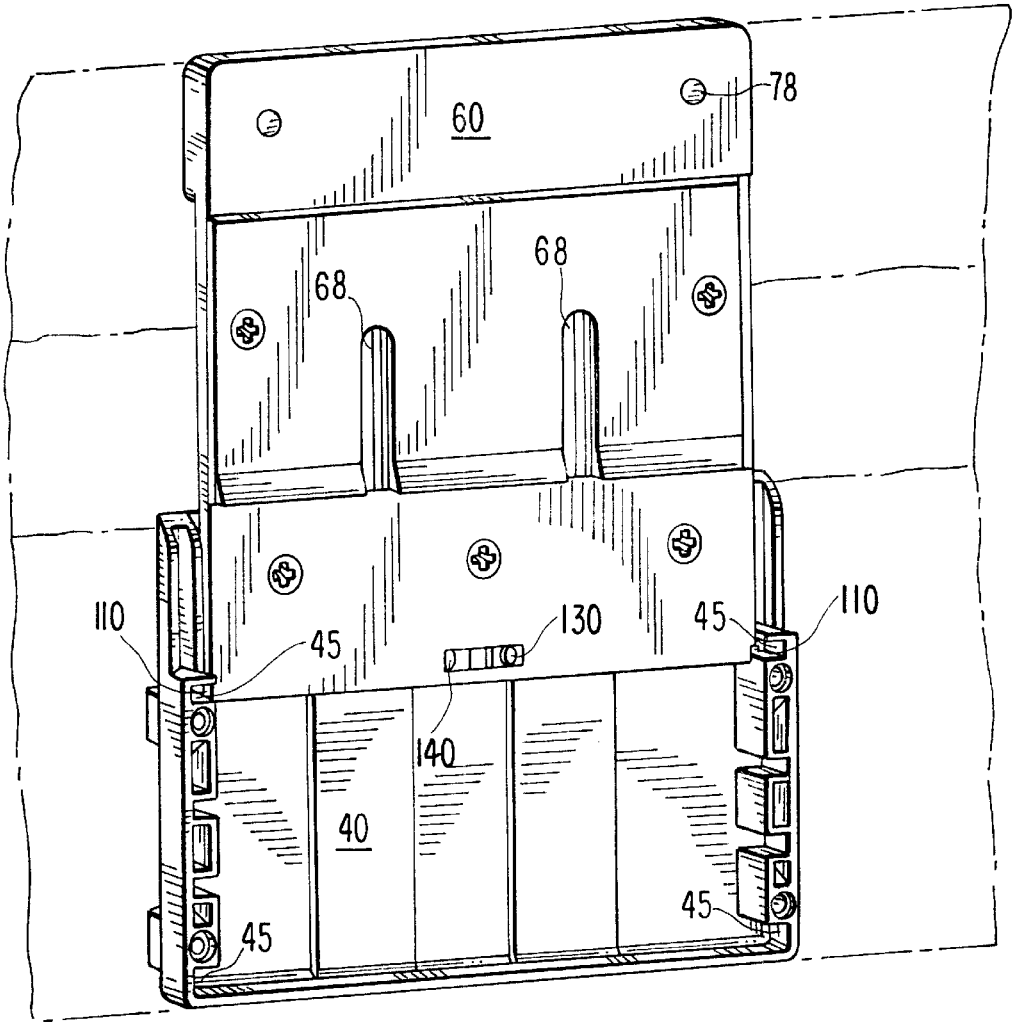
FIG. 7B is an exterior plan view of the item of luggage and locking expansion mechanism in FIG. 7A.
Figure 7C:
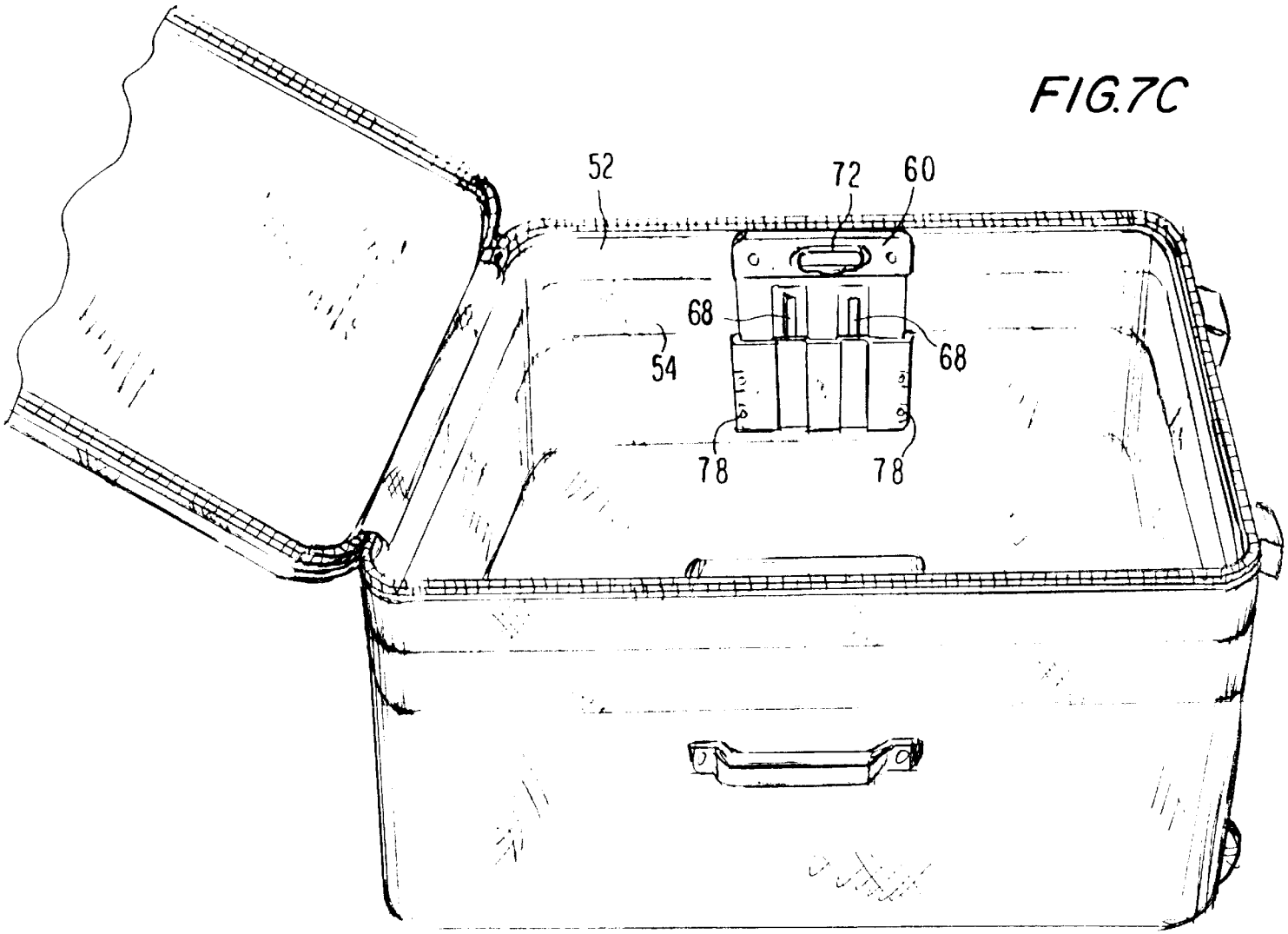
FIG. 7C is an interior perspective view of the item of luggage and locking mechanism plates shown in FIG. 7A.

As shown in FIG. 4, first plate 40 preferably includes a pair of parallel spaced-apart locking lugs 42 slidably coupled to a pair of corresponding parallel spaced-apart elongated lug receiving slots 68 positioned between legs 30 located on second plate 60. Expansion plates (40,60) are slidably engaged and lockable by positioning locking element 110 in any pair of opposing locking apertures 45 in order to permit expansion and retraction of zipperless gusset 56 by adjustments in the height of expandable body 50.

Figure 3:
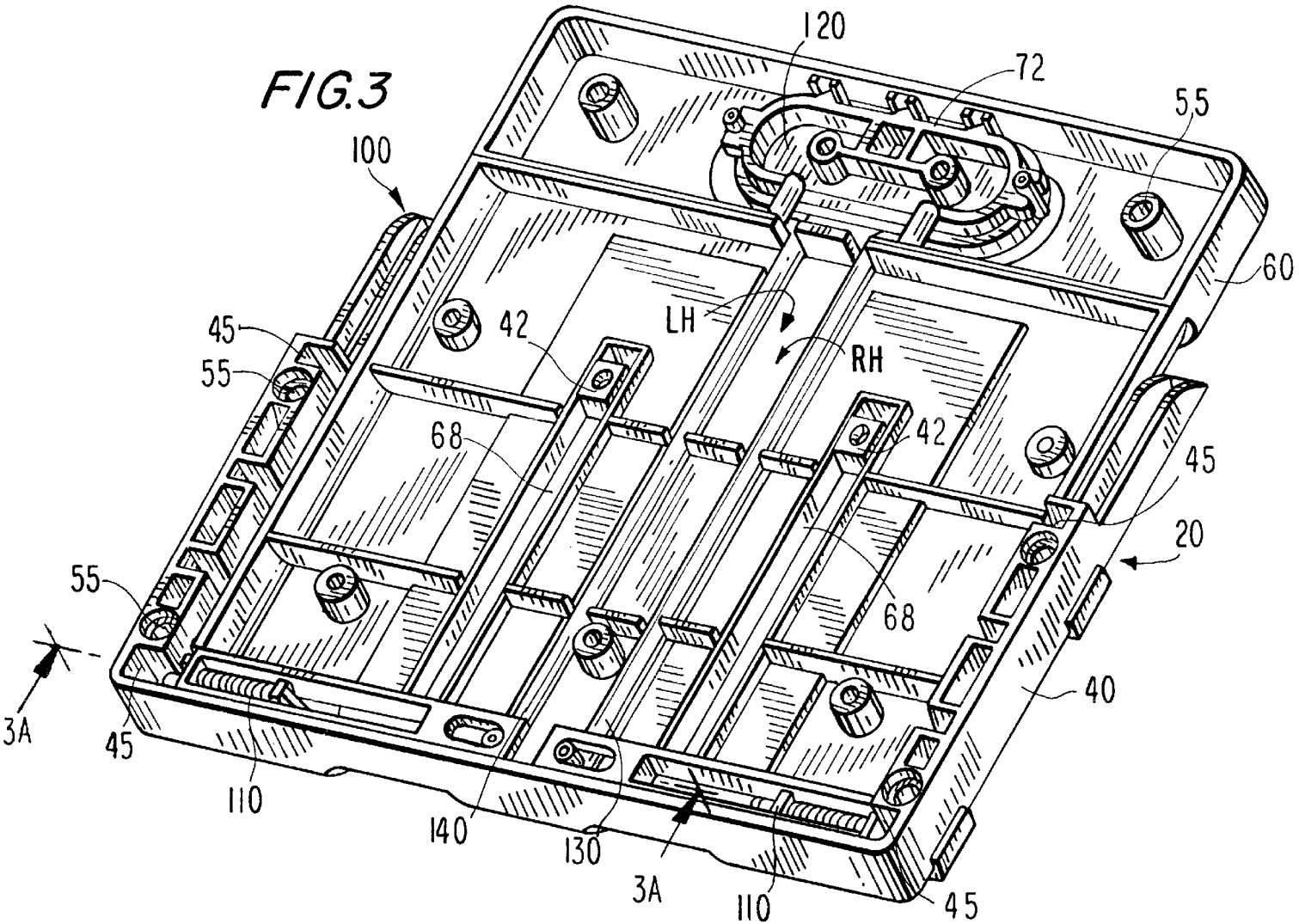
FIG. 3 is a cutaway view of the multipositional locking expansion mechanism according to one embodiment of the invention.
Figure 3A:
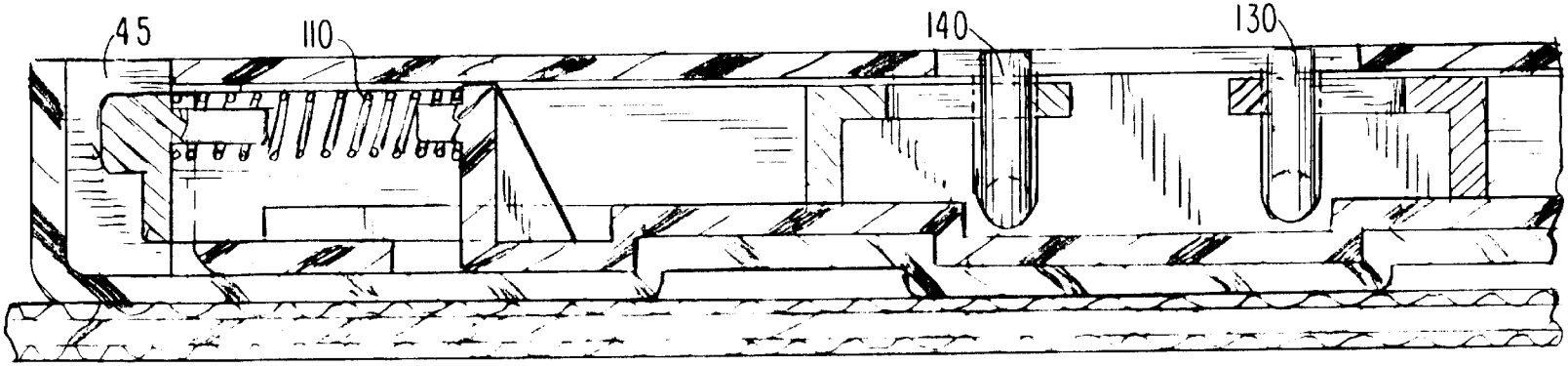
FIG. 3A is a cross-sectional view taken along line 3A—3A of FIG. 3 showing the mechanism in the locked position.
Figure 3B:
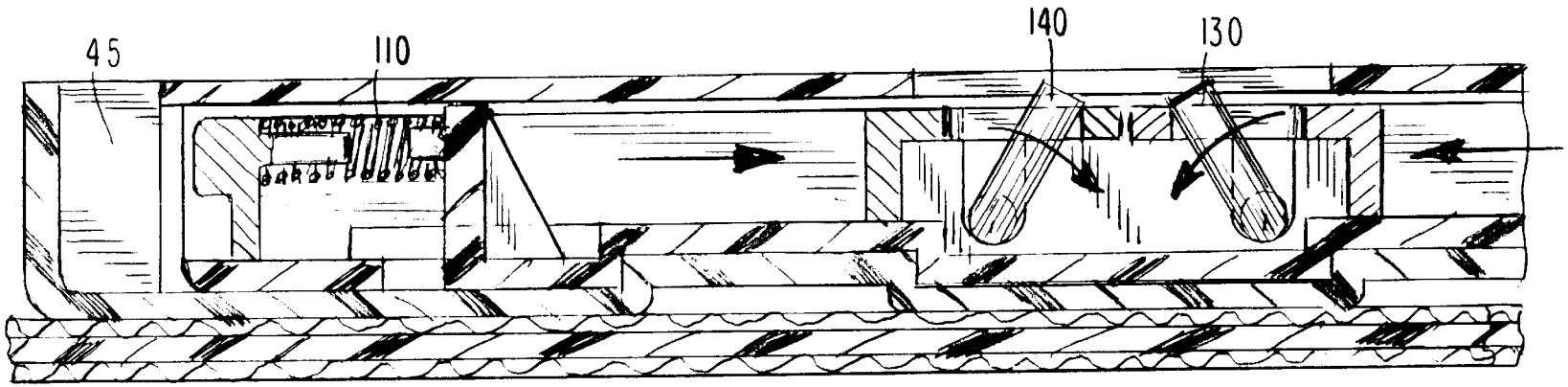
FIG. 3B is the cross-sectional view of FIG. 3A showing the mechanism in the released position.

As depicted in FIG. 3, lock element 110, preferably engaged for release by a spring-biased rotating crank (130, 140) activated mechanism, is capable of engaging lower and upper locking apertures 45 located on either side of stationary plate 40 to thereby provide at least two locking positions for sliding expansion plate 60 with respect to first expansion plate 40. Lock release element 120, preferably a push-button 88 activating mechanism to rotate cranks 130 and 140, thereby disengaging lock element 110 from apertures 45, is capable of unlocking expansion plates (40,60) when activated, permitting locking lugs 42 to slide within receiving slots 68.

In a preferred embodiment, the release mechanism actuator 120 is easily operated and conveniently located near or on a sliding plate handle or grip 72 situated towards the top region of expandable body 50 to provide for easy accessibility. The user is thus able to adjust the interior storage volume of the item of luggage 10 without having to unpack in order to gain access to the unlocking mechanism 120. In a preferred embodiment, the item of luggage 10 comprises a pair of locking expansion mechanisms 20 located on opposing sidewalls.

In another embodiment of the invention depicted in FIG. 2, an item of luggage 10 further includes gusset retracting means, which in the embodiment shown comprises a web 76 of resilient plastic material or the like attached to the interior side 84 of gusset 54, situated between outer gusset wall and inner adjacent side walls of main body 14 and the expandable body 50. Resilient web 76 extends between the respective opposing peripheral region of upper frame 28 and extendable frame 52, so that when expanded luggage item 10 is collapsed, gusset 54 is drawn towards the interior region of the luggage, thereby allowing the opposing frame elements (28,52) to come into contact with each other, without the user having to manually retract gusset 54 to the desired interior position, and away from interfering with the retraction of luggage 10. The web of resilient plastic material 76 is preferably attached to the interior side 84 of gusset 54 by an appropriate fastening means including, but not limited to, an adhesive, mechanical fasteners, stitching, or the like.

Alternatively, the resilient web 76, or individual resilient elements in the form of flexible stays (not shown), can be sewn to the gusset 54, or alternatively, in a sleeve or pockets provided for this purpose Support frame members (26, 28, 52) are preferably made of a substantially rigid material to provide strength and rigidity to top, bottom and side walls of main body 14 and expanding body assembly 50. Support frame members (26, 28, 52) each optionally have the shape of an endless loop-like rectangular member and extend around the outer perimeter of main body 14 and expanding body assembly 50, between an inner lining 22 and outer skin 80.

Expansion plate 40, cover plate 75 and sliding expansion plate 60 are each made from any suitable rigid material, such as plastic, or from any suitable metal, such as steel or aluminum. Fasteners 78 can be of any suitable type, such as conventional rivets or screws.

Although luggage 10 has been shown with two locking expansion mechanisms 20 on opposing side walls, it should be appreciated that an item of luggage having more or less than two locking expansion mechanisms 20 is within the scope of the present invention. As will be understood by one of ordinary skill in the art seen, a variety of alternative embodiments can be provided within the scope of the present invention.

As shown in FIG. 2, a wheeled framework and wheels 48 are preferably mounted on the rear of bottom wall of main body 14 and are each made from any suitable material such as plastic and are secured together by any suitable fastening means such as rivets (not shown). The wheels are preferably made from rubber, plastic or any other suitable material, and are rotatably mounted in spaced apart positions along the rear lower edge of main body 14 for rotation about an axle. In an alternative embodiment, luggage 10 of the present invention can be provided without wheeled framework and wheels 48 so as to be suitable only for carrying by a handle, shoulder strap or both. The framed case can also be other than in the shape of a right parallel piped as depicted in FIGS. 1–7.

A first handle means or strap handle 46 is optionally secured in the middle of top wall to permit carrying of suitcase 10 in an upright position. A second handle means or strap handle 44 is optionally secured in the middle of outside wall (see FIG. 2) to permit carrying of suitcase 10 on its side.

A zipper 38 extends around the edge of access panel 24 and top edge of expandable body 50. Panel 24 preferably pivots at 36 from a top wall of the expandable body to open and thus permit access to the main storage cavity for the storage and or transport of items, including, but not limited to, clothing and other travel accessories. One or more secondary zippers (not shown) optionally extending across the outside of door 24 to permit access to front pockets (not shown) provided in panel 24 can also be provided.

It will be apparent to those skilled in the art that various modifications and variations can be made to the present invention without departing from the spirit and scope of the invention. Thus, it is intended that the present invention cover the modifications and variations of this invention that come within the scope of the appended claims and their equivalents.

What is claimed is:

1. An item of luggage (10) having an adjustable interior volume comprising:

a main body (14) having a bottom floor (12), a plurality of opposing sidewalls **(18*a,b,c,d*,), a first frame (26) and a second frame (28)**;

an expandable member (50) having an adjustable height comprising a plurality of opposing sidewalls, an expandable member support frame (52) and a zipperless expandable gusset (54), wherein the gusset is located between and expandably connected to the main body (14) and the expandable support frame (52);

an access panel (24) joined to the expandable member (50); and locking expansion means (20) connecting the main body (14) to the expandable member (50) comprising a first fixed plate (40) and a second sliding expansion plate (60) slidably coupled together, wherein the first plate (40) is mounted to the main body and includes a locking lug member (42), and a first lock aperture (45) at a collapsed position and second lock aperture (45) at an expanded position, the second plate (60) is secured to the expanding member and includes a releasable locking mechanism (100) and a lug receiving slot (68) located and dimensioned to slidably receive the locking lug member (42) through the receiving slot (68) so as to couple the locking lug member (42) and receiving slot (68), such that adjustment of the height of the expandable member results in a corresponding adjustment of the interior volume of the luggage, and wherein the releasable locking mechanism (100) includes a moveable lock element (110) capable of engaging the first and second lock apertures (45) in order to control the sliding and locking of the second plate with respect to the first plate, and a lock release element (120) capable of disengaging the lock element (110), whereby the locking lug (42) slides in the lug receiving slot (68) when the lock element is disengaged.

2. The item of luggage according to claim 1, wherein said locking lug member comprises a plurality of spaced apart locking lug members, and said receiving slot comprises a plurality of substantially parallel receiving slots for slidably receiving the plurality of locking lug members.

3. The item of luggage according to claim 1, wherein the first plate comprises a plurality of first plates mounted on opposing sidewalls of the main body, and the second plate comprises a plurality of second plates mounted on opposing sidewalls of the expanding member.

4. The item of luggage according to claim 1, wherein the locking expansion means comprises an opposing pair of first expansion plates (40), and an opposing pair of sliding second expansion plates (60) slidably coupled together.

5. The item of luggage according to claim 1, further comprising gripping means (72) located on the sliding second expansion plate (60) to facilitate the sliding up or down of said second plate.

6. The item of luggage according to claim 5, wherein the gripping means comprises a handle (72).

7. The item of luggage of claim 6, wherein the handle is formed in the end of the second plate adjacent the expandable member and access panel.

8. The item of luggage according to claim 1, wherein the lock releasing element (120) comprises a spring-biased push button (88).

9. The item of luggage of claim 1, wherein the first and second plates of the locking expansion means are formed of a polymeric material.

10. The item of luggage of claim 1, further comprising a manual lock release actuator, said actuator being disposed proximate the expandable member and the access panel.

11. The item of luggage of claim 1, wherein the support frames are metal.

12. The item of luggage of claim 1, wherein the gusset and sidewalls are constructed of the same fabric.

13. The item of luggage of claim 1, wherein the gusset expands to increase the internal storage volume by at least ten percent.

14. The item of luggage of claim 1, wherein the length of the expanded gusset is in the range from three inches to six inches.

15. The item of luggage of claim 1 further comprising gusset retracting means attached to the interior side of the gusset, whereby said gusset is drawn to the interior of the luggage compartment in the non-expanded position.

16. The item of luggage of claim 15, wherein the gusset retracting means is a web of resilient plastic material.

17. The item of luggage of claim 16, wherein the gusset is secured to a central portion of the resilient web, and the longitudinal edges of the web extend to the peripheral portions of the opposing second frame and the expandable frame.

18. The item of luggage of claim 16, wherein a separate portion of the web extends along each of the sidewalls.

19. The item of luggage of claim 15, wherein the gusset is secured to the retracting means by fasteners selected from the group consisting of adhesive, stitching and rivets.

20. The item of luggage of claim 15, wherein the gusset retracting means is integrally formed with the gusset.

* * * * *